US006860460B2

(12) United States Patent
Rellergert

(10) Patent No.: US 6,860,460 B2
(45) Date of Patent: Mar. 1, 2005

(54) METHOD AND APPARATUS FOR ASSEMBLY OF STAIR FORMS

(76) Inventor: Leroy J. Rellergert, 407 N. Pine St., Perryville, MO (US) 63775

( * ) Notice: Subject to any disclaimer, the term of this patent is extended or adjusted under 35 U.S.C. 154(b) by 0 days.

(21) Appl. No.: 10/310,248

(22) Filed: Dec. 3, 2002

(65) Prior Publication Data

US 2004/0104331 A1 Jun. 3, 2004

(51) Int. Cl.[7] ..... E04G 13/06; B28B 7/22
(52) U.S. Cl. ..... 249/14; 249/208
(58) Field of Search ..... 249/14, 208; 52/182, 52/188, 191, 702, 712; 29/428, 525.01

(56) References Cited

U.S. PATENT DOCUMENTS

| | | | | |
|---|---|---|---|---|
| 1,787,799 A | * | 1/1931 | Soule et al. | 249/14 |
| 2,306,722 A | | 12/1942 | Fox | |
| 2,386,161 A | | 10/1945 | Hawes | |
| 2,857,646 A | | 10/1958 | McLoughlin | |
| 2,863,207 A | | 12/1958 | Davis et al. | |
| 3,014,685 A | | 12/1961 | Jensen et al. | |
| 3,331,579 A | | 7/1967 | Petersen | |
| 3,612,472 A | * | 10/1971 | Steigerwaldt, Jr. | 249/208 |
| 3,841,595 A | | 10/1974 | Brown | |
| 3,845,598 A | | 11/1974 | Tate | |
| 3,851,431 A | | 12/1974 | Klein | |
| 3,863,885 A | | 2/1975 | McLoughlin | |
| 3,885,365 A | | 5/1975 | Cox | |
| 3,902,948 A | | 9/1975 | Morros | |
| 3,986,579 A | | 10/1976 | Howard et al. | |
| 3,993,282 A | | 11/1976 | Berman et al. | |
| 4,250,672 A | | 2/1981 | Seegers et al. | |
| 4,422,270 A | | 12/1983 | Lapointe et al. | |
| 4,635,895 A | | 1/1987 | Johnson, Jr. et al. | |
| 4,709,520 A | | 12/1987 | Vochatzer | |
| 4,775,131 A | | 10/1988 | Baumgartner | |
| 4,846,437 A | | 7/1989 | Fitzgerald | |
| 4,866,894 A | | 9/1989 | Brown | |
| 4,899,504 A | | 2/1990 | Hirschhorn | |
| 4,916,796 A | | 4/1990 | Baumgartner | |
| 5,026,018 A | | 6/1991 | Ayala | |
| 5,133,530 A | | 7/1992 | Thoresen | |
| 5,293,722 A | | 3/1994 | Reimann | |
| 5,511,347 A | | 4/1996 | Schwarz | |
| 5,636,483 A | | 6/1997 | Wille | |
| 5,791,101 A | | 8/1998 | Wallace | |
| 5,799,448 A | | 9/1998 | Dunk | |
| 5,899,032 A | | 5/1999 | Buzby | |
| 6,029,408 A | | 2/2000 | Cavaness | |
| 6,088,977 A | | 7/2000 | Lawrence | |
| 6,295,772 B1 | | 10/2001 | Whitson | |
| 6,354,403 B1 | | 3/2002 | Truckner et al. | |
| 6,374,556 B2 | | 4/2002 | Crant et al. | |
| 6,397,529 B1 | | 6/2002 | Grenier | |
| 2002/0088669 A1 | | 7/2002 | Truckner et al. | |
| 2002/0124492 A1 | | 9/2002 | Gobeil | |

* cited by examiner

*Primary Examiner*—Michael Safavi
(74) *Attorney, Agent, or Firm*—Husch & Eppenberger, LLC

(57) ABSTRACT

Construction forms for making concrete forms for making stairs have a bracket with a stringer mount face and a riser mount face. Each mount face has mounting structure located thereon. A longitudinally extending stringer stop extends away from and perpendicular to a stringer mount plane in a first direction, the stringer stop having a surface adapted to abut a bottom of a stringer. A laterally extending first riser stop has a first riser abutting surface. The first riser stop extends laterally away from the riser mount face in a second direction and is longitudinally spaced a first distance from the stringier stop. The second direction is perpendicular to the first direction. The first riser abutting surface is adapted to abut a top of a riser. Use of the bracket in an assembly with a stringer and a riser are also disclosed.

18 Claims, 5 Drawing Sheets

METHOD AND APPARATUS FOR ASSEMBLY OF STAIR FORMS

SUMMARY OF THE INVENTION

The present invention relates to construction forms and more specifically to a device for making concrete forms for making stairs. Pouring concrete requires a form to hold the liquid concrete until it can dry to its solid form. The top surface of the wet concrete is left open to allow excess material removal. Creating a form to pour stairs involves securing a set of risers to a set of stringers. The risers contain the wet concrete and when removed correspond to the rise of each step. The top surface of the wet concrete hardens to form the tread of each step. Currently, a stair form is created by cutting portions out of a piece of wood (see FIGS. 8–9). Removing the outline of the stairs, including the thickness of the risers and a finishing space, forms a stringer. The stringer is then hung in place by anchoring at a floor elevation and securing at a landing elevation. Additional stringers are added at regular intervals between the right and left sides of the desired stairs. A portion of each riser is removed to allow a finish tool access to the portion of the tread adjacent the next rise. The risers are then secured at a right angle to the stringer using an additional block of wood attached to both the stringer and the riser. After the concrete dries, the risers and stringers are removed and the stringers must be discarded because of the unlikelihood of needing that exact configuration. This method of creating stair forms is time consuming and wasteful. There is a need for a system that is quicker and allows reuse of the stringers.

U.S. Pat. No. 4,916,796 discloses a method for assembly of stair forms. The apparatus allows the risers to be positioned without having to cut the stringer. This apparatus requires attachment at a pivot point 22 to a line marked on the stringer. The apparatus is then positioned using scales 56 located on an arcuate edge of the scales and the line on the stringer. Kneeboard 72 is added to allow a worker to kneel on the kneeboard to finish the concrete tread. There are a couple of drawbacks to this system. The kneeboard must be removed in order to finish the portion of the tread previously covered by the kneeboard. Concrete work is notoriously messy and the back surface of the apparatus does not pivot well when dirty. In addition, access to the previous apparatus is necessary to install a subsequent apparatus. There is a need for a system that does not require a separate kneeboard. There is also a need for a system that is easy to use and allows repeated use of the apparatus. The present invention meets those needs.

One aspect of the present invention is an apparatus having a bracket having a first end opposite a second end. The bracket further includes a stringer mount face and a riser mount face including first and second riser mounting regions. The stringer mount face and the riser mount face extending longitudinally between the first end and the second end. At least a portion of the stringer mount face defines a stringer mount plane and at least a portion of the riser mount face defines a riser mount plane. The bracket is configured such that the stringer mount plane is generally perpendicular to the riser mount plane. A riser mounting structure is located on the riser mount face. A stringer mounting structure is located on the stringer mounting face. A longitudinally extending stringer stop extends away from and perpendicular to the stringer mount plane. The stringer stop has first and second abutting surfaces. One of the first and second abutting surfaces can abut a bottom of a stringer such that the stringer mounting face can be positioned adjacent a side of the stringer. The apparatus further includes a laterally extending first riser stop having a first riser abutting surface. The first riser stop extends away from the riser mount face and is longitudinally spaced a first distance from the stringer stop. The first riser mounting region is located between the first riser stop and the second end. The first riser abutting surface is adapted to abut a top of a riser such that the first riser mounting region of the riser mounting face is positioned adjacent a side of the riser.

Another aspect of the present invention is an assembly comprising an apparatus, a stringer and a riser. The apparatus has a bracket having a first end opposite a second end. The bracket further includes a stringer mount face and a riser mount face including first and second riser mounting regions. The stringer mount face and the riser mount face extend longitudinally between the first end and the second end. At least a portion of the stringer mount face defines a stringer mount plane and at least a portion of the riser mount face defines a riser mount plane. The bracket is configured such that the stringer mount plane is generally perpendicular to the riser mount plane. The apparatus further comprises a riser mounting structure located on the riser mount face and a stringer mounting structure located on the stringer mounting face. A longitudinally extending stringer stop extends away from and perpendicular to the stringer mount plane. The stringer stop has first and second abutting surfaces. A laterally extending first riser stop has a first riser abutting surface. The first riser stop extends away from the riser mount face and is longitudinally spaced a first distance from the stringer stop. A laterally extending second riser stop has a second riser abutting surface. The second riser stop extends away from the riser mount face and is longitudinally spaced a second distance from the stringer stop. The first distance is equal to the second distance. The first riser mounting region is located between the first riser stop and the second end and the second riser mounting region is located between the second riser stop and the first end. The assembly further comprising a stringer having a stringer bottom, a first stringer side and a second stringer side. The stringer is attached to the apparatus such that one of the first and second stringer sides is adjacent the stringer mounting face and the stringer bottom is abutted by one of the first and second abutting surfaces of the stringer stop. The assembly further comprising a riser having a riser top and a riser side. The riser is attached to the apparatus such that the riser side is adjacent one of the first and second riser mounting regions and the riser top is abutted by one of the first and second riser stops.

Another aspect of the present invention is a method of creating a form for pouring concrete steps. The method comprising providing an apparatus having a bracket having a first end opposite a second end. The bracket further includes a stringer mount face and a riser mount face including first and second riser mounting regions. The stringer mount face and the riser mount face extend longitudinally between the first end and the second end. At least a portion of the stringer mount face defines a stringer mount plane and at least a portion of the riser mount face defines a riser mount plane. The bracket is configured such that the stringer mount plane is generally perpendicular to the riser mount plane. The apparatus further comprises a riser mounting structure located on the riser mount face and a stringer mounting structure located on the stringer mounting face. A longitudinally extending stringer stop extends away from and perpendicular to the stringer mount plane. The stringer stop has first and second abutting surfaces. A laterally extending first riser stop has a first riser abutting surface. The first riser stop extends away from the riser mount face and is longitudinally spaced a first distance from the stringer stop. A laterally extending second riser stop has a second riser abutting surface. The second riser stop extends away from the riser mount face and is longitudinally spaced a second distance from the stringer stop. The first distance is equal to the second distance. The first riser mounting region is located between the first riser stop and the second end and the second riser mounting region is located between the second riser stop and the first end. The method further comprising providing a stringer having a stringer bottom, a first stringer side and a second stringer side. Providing a riser having a riser top and a riser side. Securing the apparatus to the stringer; and securing the apparatus to the riser.

Other features and advantages will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
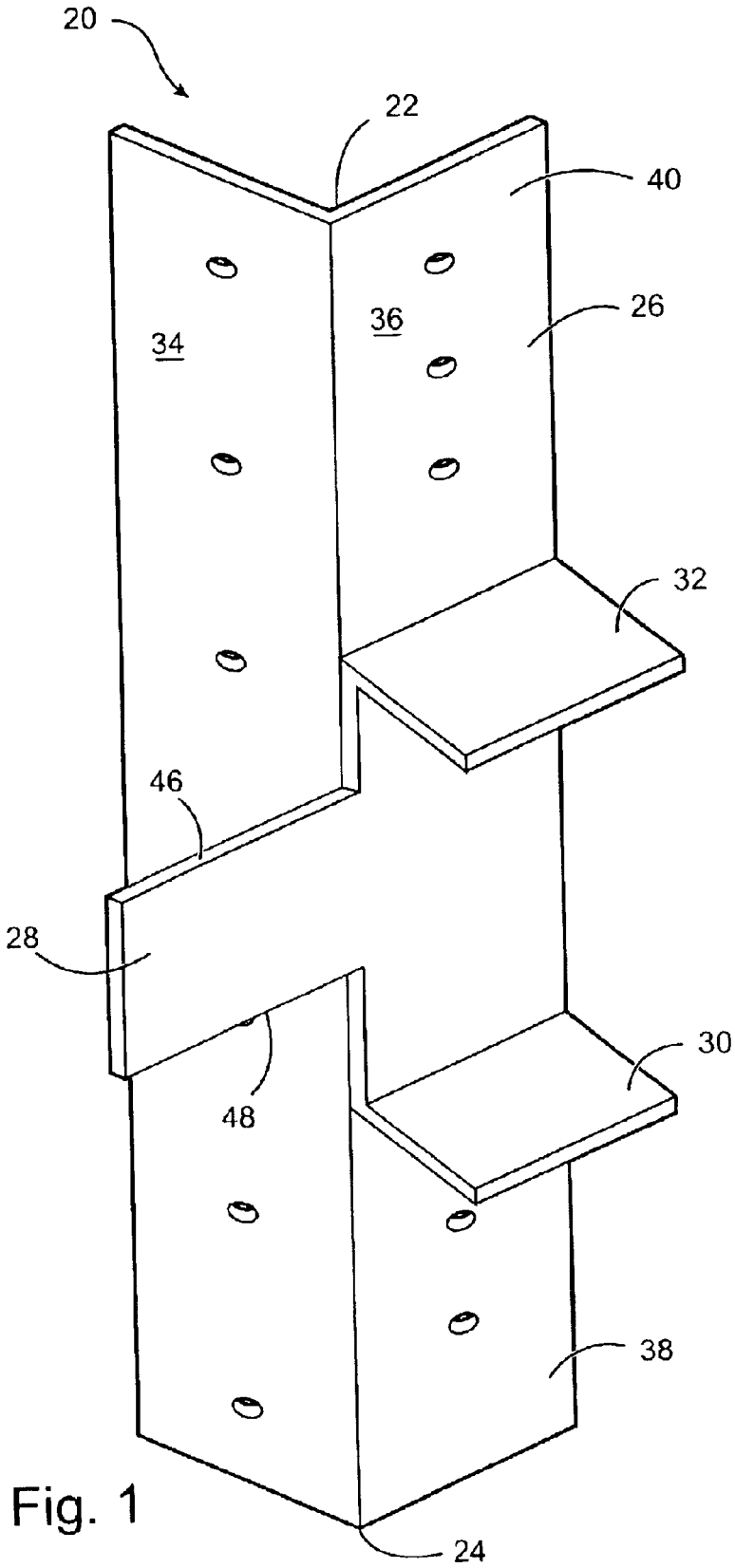
FIG. 1 is a perspective view of an apparatus according to the invention.

Referring now to the drawings, FIG. 1 shows an apparatus 20 according to the present invention. The apparatus has a first end 22 opposite a second end 24 of a bracket 26. The apparatus includes the bracket 26, a stringer stop 28, and at least a first riser stop 30. The apparatus may also include a second riser stop 32.

The bracket 26 has a stringer mount face 34 and a riser mount face 36. The riser mount face includes a first mounting region 38 and a second riser mounting region 40. The stringer mount face and the riser mount face extend longitudinally between the first end 22 and the second end 24. At least a portion of the stringer mount face defines a stringer mount plane and at least a portion of the riser mount face defines a riser mount plane. The bracket is configured such that the stringer mount plane is generally perpendicular to the riser mount plane.

Figure 3:
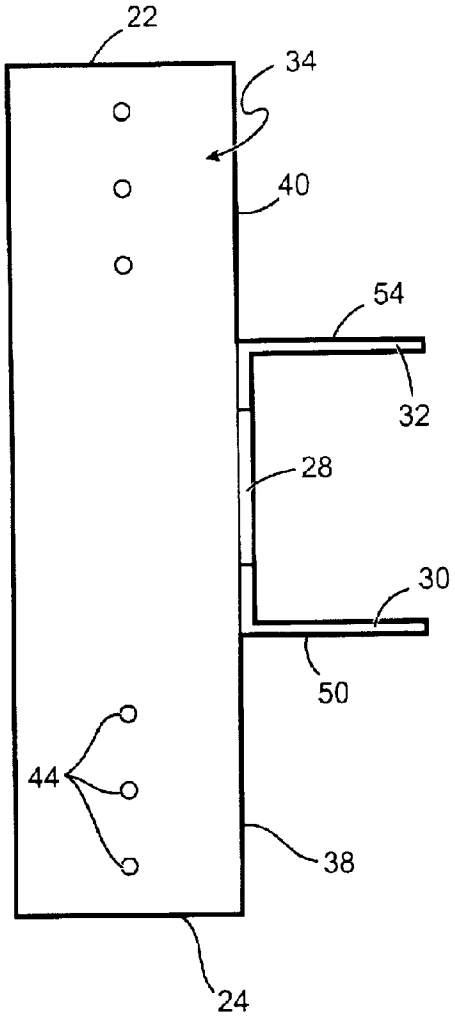
FIG. 3 is a side plan view of the apparatus of FIG. 1.
Figure 2:
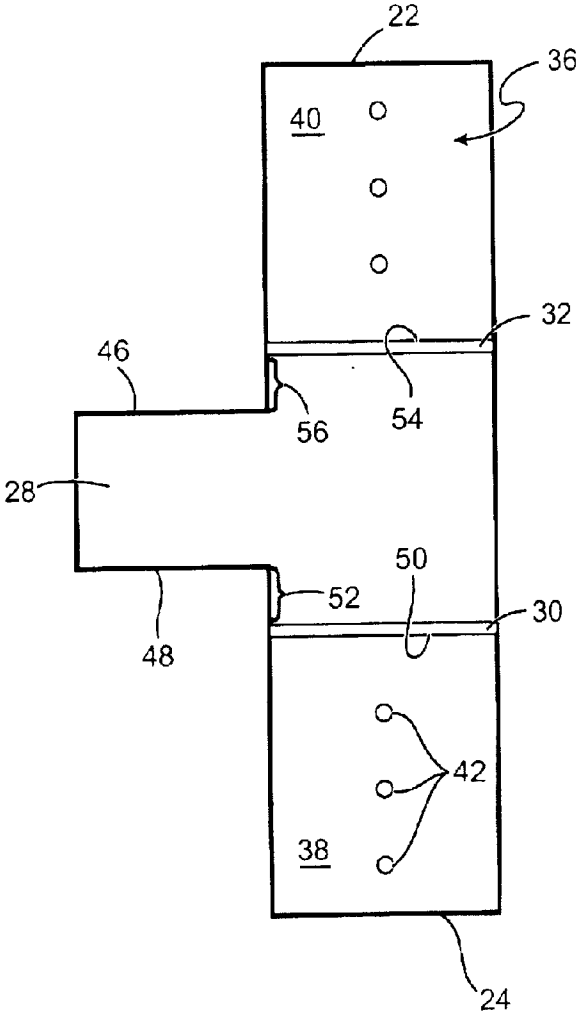
FIG. 2 is a front plan view of the apparatus of FIG. 1.

Referring now to FIGS. 2–3 (a side and front plan view respectively of the apparatus of FIG. 1), the riser mount face 36 and the stringer mount face 38 is shown. A riser mounting structure 42 is located on the riser mount face. A stringer mounting structure 44 is located on the stringer mounting face. The stringer stop 28 extends longitudinally away from and perpendicular to the stringer mount plane. The stringer stop has a first abutting surface 46 and a second abutting surface 48. If one of the first and second abutting surfaces abuts a stringer bottom the stringer mounting face can be positioned adjacent a stringer side.

The first riser stop 30 extends laterally from the riser mount face 36. The first riser stop has a first riser abutting surface 50. The first riser stop extends away from the riser mount face and is longitudinally spaced a first distance 52 from the stringer stop 28. The first riser mounting region 38 is located between the first riser stop 30 and the second end 24 and the second riser mounting region 40 is located between the second riser stop 32 and the first end 22. The first riser abutting surface 50 is adapted to abut a riser top such that the first riser mounting region 38 of the riser mounting face is positioned adjacent a riser side.

The apparatus can also include the second riser stop 32. The second riser stop has a second riser abutting surface 54. The second riser stop extends away from the riser mount face and is spaced longitudinally a second distance 56 from the stringer stop 28. The second distance 56 is equal to the first distance 52. The second riser mounting region 40 is located between the second riser stop and the first end 22. The second riser abutting surface abuts a riser top such that the riser mounting face may be positioned adjacent a side of the riser.

In the embodiment shown, the riser mounting structure 42 is a plurality of first riser holes in the riser mounting face 36. The first riser holes are spaced longitudinally and located between the first riser stop and the second end 24. The riser mounting structure 42 can also include a plurality of second riser holes space longitudinally and located between the second riser stop and the first end 22. The riser holes are dimensioned to receive a wood screw. The stringer mounting structure 44 is a plurality of first stringer holes in the stringer mounting face 24. The first stringer holes are spaced longitudinally and located between the stringer stop and the first end 22. The stringer mounting structure may also include a plurality of second stringer holes spaced longitudinally and located between the stringer stop and the second 24. The stringer holes are dimensioned to receive a wood screw.

Figure 5:
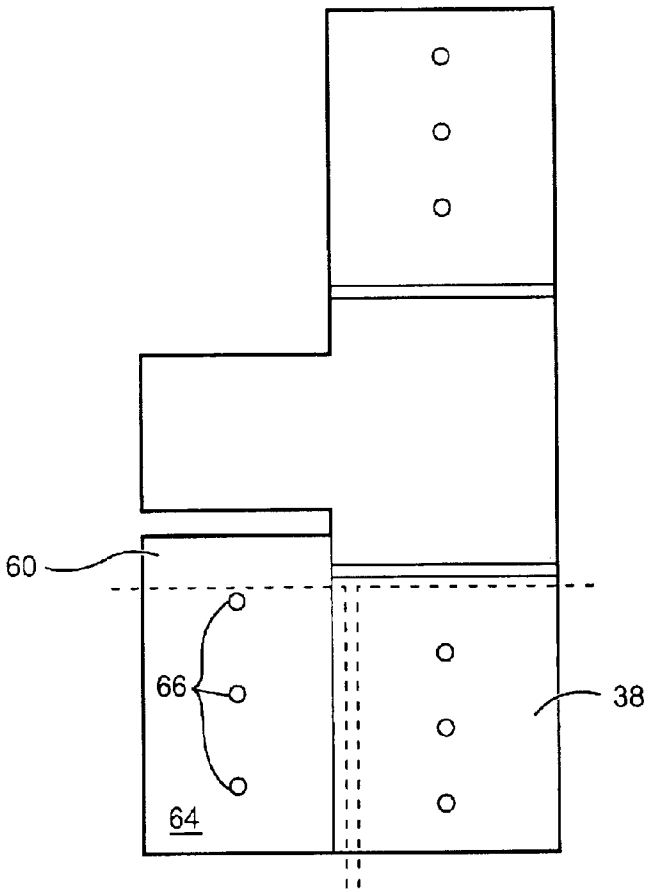
FIG. 5 is a front plan view of an extension clip and apparatus according to the present invention.
Figure 4:
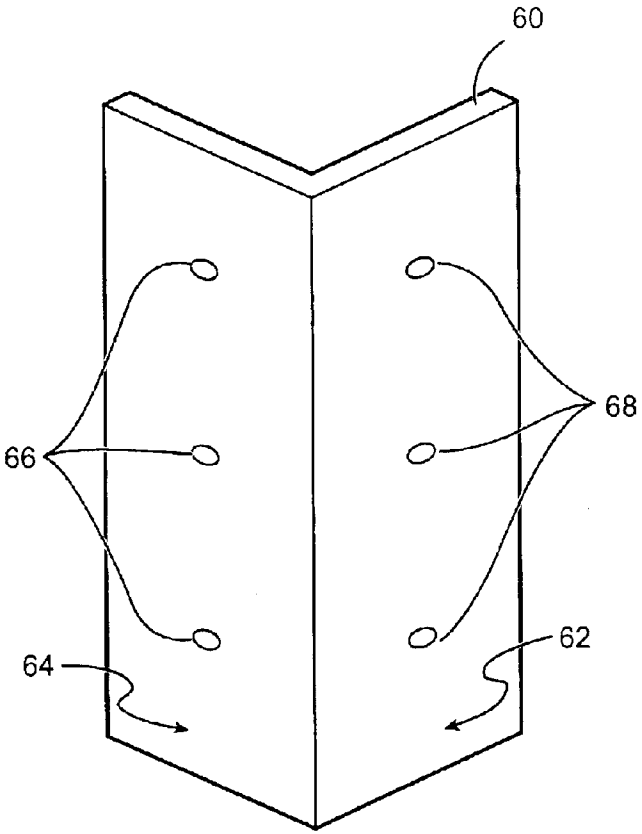
FIG. 4 is a perspective view of an extension clip according to the invention.

Referring now to FIGS. 4–5, the apparatus 20 may also include a riser extension clip 60. The riser extension clip has an attaching face 62 and an extension face 64. The extension face includes an extension mounting structure 66. At least a portion of the attaching face defines an attaching plane and at least a portion of the extension face defines an extension plane. The riser extension clip is configured such that the attaching plane is generally perpendicular to the extension plane. The riser extension clip attaches to the apparatus such that the attaching face 62 is in a face to face orientation with the stringer mount face 34 and the extension face 64 is adjacent the first riser mounting region 38. In the embodiment shown, the extension clip attaches to the apparatus via an attaching face mounting structure 68. The attaching face mounting structure 68 is a plurality of holes that align with the plurality of second stringer holes when the extension clip and the apparatus are in a face to face orientation. The extension clip can then be bolted to the apparatus.

Figure 7:
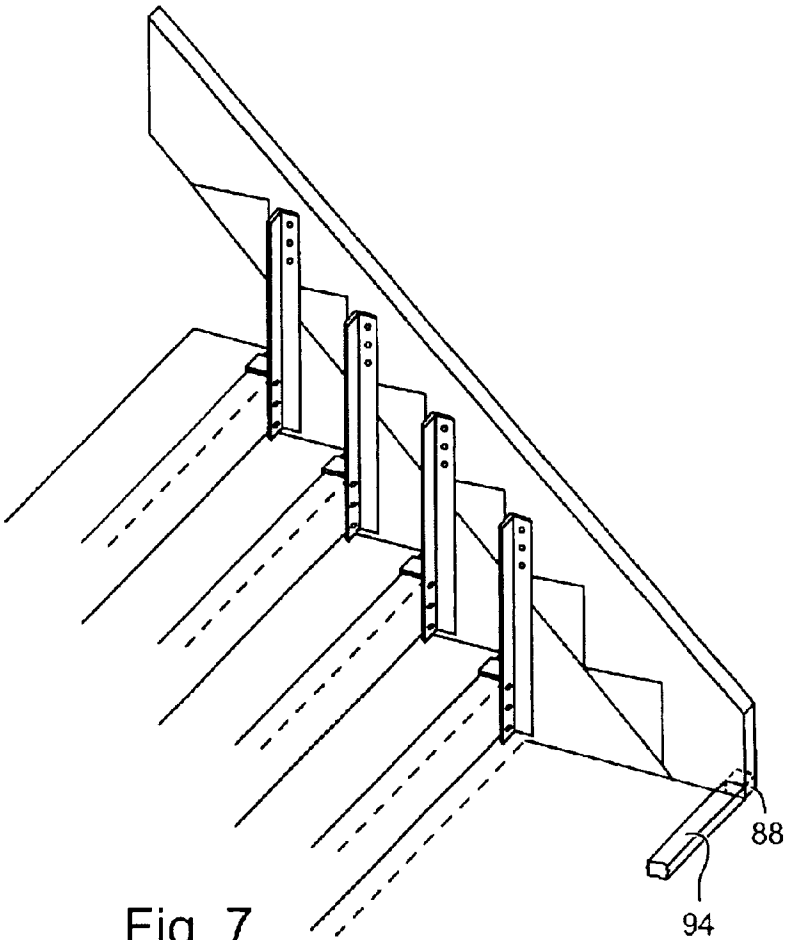
FIG. 7 is a perspective view of the assembly of FIG. 6.
Figure 6:
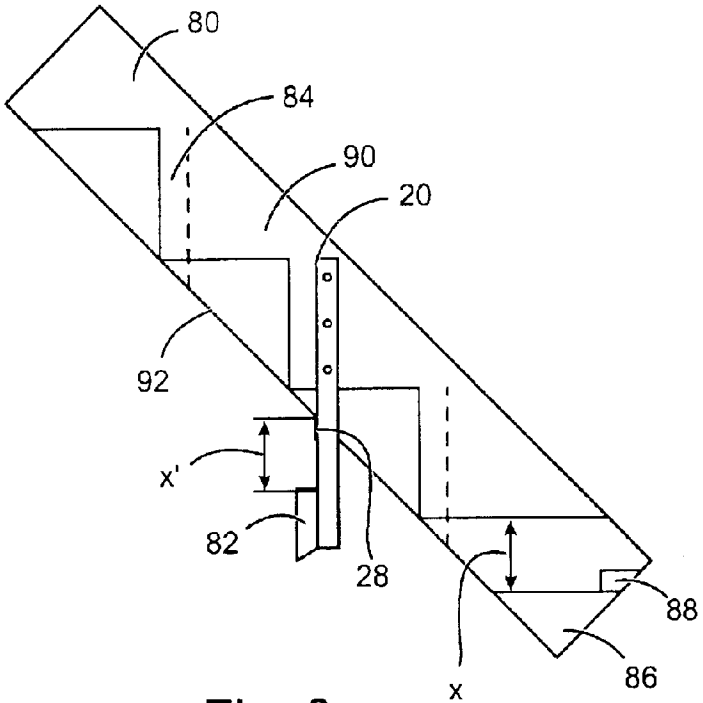
FIG. 6 is a side view of an assembly according to the present invention.
Figure 8:
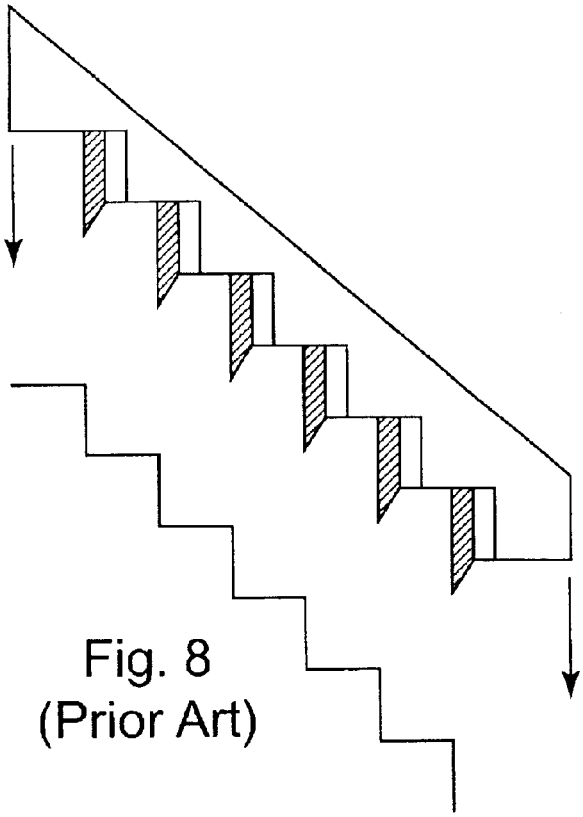
Fig. 8 (Prior Art)
FIG. 8 is a side view of an example of the prior art.
Figure 9:
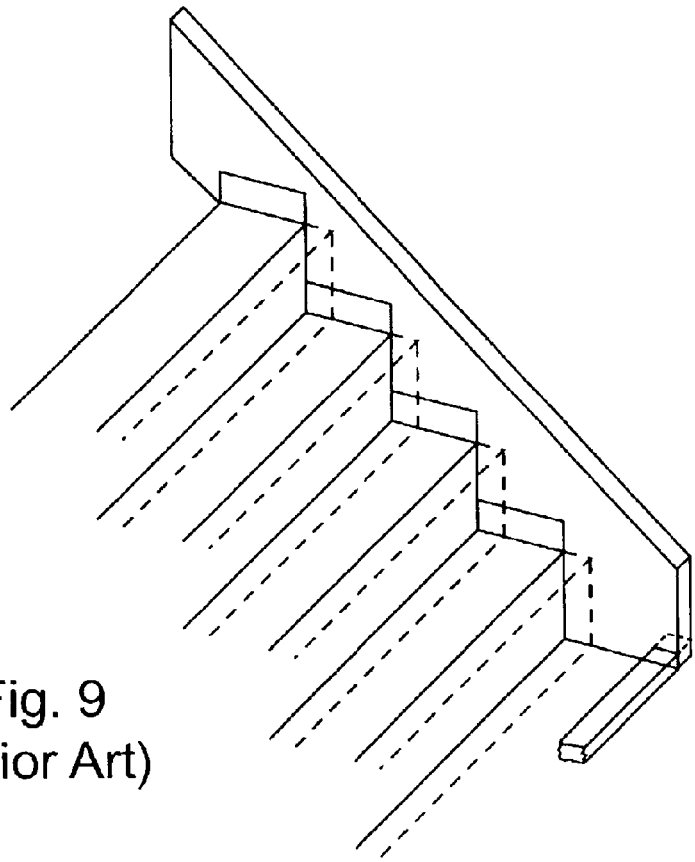
Fig. 9 (Prior Art)
FIG. 9 is a perspective view of the example shown in FIG. 8.

Referring now to FIGS. 6–7, the operation of the apparatus 20 can be demonstrated. The apparatus is shown with a stringer 80 and a riser 82 to create a form for concrete stairs. It should be understood that an existing wall (for enclosed stairs) or a side frame (for freestanding stairs) will be utilized to form the lateral boundaries of each step of the stairs. Using formulas known to those skilled in the art and based upon the total rise and run of the stairs, the dimensions of each step (and the number of steps) can be determined. After ensuring the stringer is straight, each step is drawn on the stringer side from a landing down to a floor. A toe-kick, if included, can be accounted for in this step. An additional line 84 is then drawn parallel to each rise drawn on the stringer at a distance equal to the thickness of the riser 82. The floor is also drawn where it meets the bottom of the initial step. A floor line is drawn parallel to the floor at a distance x. In the embodiment shown, the distance x is equal to a distance x' from the first stringer abutting surface 46 to the first riser abutting surface 50. A surplus 86 below the floor line is then removed. Finally, a notch 88 is added to the stringer. The bottom of each riser 82 is bevelled to allow access to the adjacent tread.

An apparatus 20 is then attached to the stringer such that the stringer mount face 34 is adjacent the stringer side 90 at a position where the riser mount plane intersects the additional line 84. With the stringer stop 28 abutting the stringer bottom, the apparatus 20 is screwed to the stringer using wood screws in the stringer mounting structure 44. The riser 82 is then attached to the apparatus 20 using wood screws in the riser mounting structure 42. When the initial riser 82 is positioned properly the stringer is anchored to the floor by affixing an anchor board 94 to the floor and then placing the notch 88 over the anchor board. In the embodiment shown the apparatus is used in a left hand positions (on the left side of the stringer). The riser is attached to the apparatus in the first riser mounting region 38. A right hand position can be achieved by flipping the apparatus over such that the second end 24 is arranged upright and the riser is mounted in the second riser mounting region 40. This process is then repeated for each riser. Additional stringers are added and the above process is then repeated.

If a riser is not long enough to cover the step then the riser extension clip 60 is used. Referring to FIG. 5 a riser and an auxiliary are shown in dashed lines abutting one another. The auxiliary is positioned so that the auxiliary top abuts the riser stop and then attaches to the riser extension clip using the extension mounting structure.

In the preferred embodiment, the stingers are 2"×10" boards and the risers are 2"×6" boards. After the risers, stringers and a plurality of apparatus have been utilized to create a form, the tops of the risers are strong enough to withstand the weight of an adult. This allows the workers to finish each tread of each step without the necessity of a kneeboard. The clearance between the bottom of the stringer and the step tread allows the tread to be finished beneath the stringer.

After the concrete has been poured and the stairs have dried the form can be removed. Because there are no moving parts the apparatus 20 can easily be reused.

As various changes could be made in the above constructions and methods without departing from the scope of the invention, it is intended that all matter contained in the above description or shown in the accompanying drawings shall be interpreted as illustrative and not in a limiting sense. Thus, the breadth and scope of the present invention should not be limited by any of the above-described exemplary embodiments, but should be defined only in accordance with the following claims appended hereto.

What is claimed is:

1. An assembly comprising:

an apparatus comprising a bracket having a first end opposite a second end, the bracket further having a stringer mount face and a riser mount face, the riser mount face including first and second riser mounting regions, the stringer mount face and the riser mount face extending longitudinally between the first end and the second end, at least a portion of the stringer mount face defining a stringer mount plane, at least a portion of the riser mount face defining a riser mount plane, the bracket configured such that the stringer mount plane is generally perpendicular to the riser mount plane, the apparatus further comprising a riser mounting structure located on the riser mount face, a stringer mounting structure located on the stringer mounting face, a longitudinally extending stringer stop extending away from and perpendicular to the stringer mount plane, the stringer stop having first and second abutting surfaces, the apparatus further comprising a laterally extending first riser stop having a first riser abutting surface, the first riser stop extending away from the riser mount face and being longitudinally spaced a first distance from the stringer stop, the apparatus further comprising a laterally extending second riser stop having a second riser abutting surface, the second riser stop extending away from the riser mount face and being longitudinally spaced a second distance from the stringer stop, the first distance equal to the second distance, the first riser mounting region located between the first riser stop and the second end, the second riser mounting region located between the second riser stop and the first end;

a stringer having a stringer bottom, a first stringer side and a second stringer side, the stringer being attached to the apparatus such that one of the first and second stringer sides is adjacent the stringer mounting face and the stringer bottom is abutted by one of the first and second abutting surfaces of the stringer stop; and a riser having a riser top and a riser side, the riser being attached to the apparatus such that the riser side is adjacent one of the first and second riser mounting regions and the riser top is abutted by one of the first and second riser stops.

2. An assembly as set forth in claim 1 wherein the first stringer side is adjacent to the stringer mounting face, the stringer bottom is abutted by the first abutting surface of the stringer stop, and the riser abuts the first riser stop.

3. An assembly as set forth in claim 1 wherein the second stringer side is adjacent to the stringer mounting face, the stringer bottom being abutted by the second abutting surface of the stringer stop, and the riser abutting the second riser stop.

4. An assembly as set forth in claim 1 further comprising:

a riser extension clip having an attaching face and an extension face, the extension face including an extension mounting structure, at least a portion of the attaching face defining an attaching plane and at least a portion of the extension face defining an extension plane, the riser extension clip configured such that the attaching plane is generally perpendicular to the extension plane, the riser extension clip attached to the bracket such that the attaching face is in a face to face orientation with the stringer mount face and the extension face is adjacent to one of the first and second riser mounting regions.

5. An apparatus comprising:

a bracket having a first end opposite a second end, the bracket further having a stringer mount face and a riser mount face, the riser mount face including first and second riser mounting regions, the stringer mount face and the riser mount face extending longitudinally between the first end and the second end, at least a portion of the stringer mount face defining a stringer mount plane, at least a portion of the riser mount face defining a riser mount plane, the bracket configured such that the stringer mount plane is generally perpendicular to the riser mount plane;

a riser mounting structure located on the riser mount face;

a stringer mounting structure located on the stringer mounting face;

a longitudinally extending stringer stop extending in a first direction away from and perpendicular to the stringer mount plane, the stringer stop having first and second abutting surfaces, one of the first and second abutting surfaces being adapted to abut a bottom of a stringer such that the stringer mounting face can be positioned adjacent a side of the stringer;

a laterally extending first riser stop having a first riser abutting surface, the first riser stop extending laterally away from the riser mount face in a second direction and being longitudinally spaced a first distance from the stringer stop, said second direction being substantially perpendicular to the first direction, the first riser mounting region located between the first riser stop and the second end, the first riser abutting surface adapted to abut a top of a riser such that the first riser mounting region of the riser mounting face is positioned adjacent a side of the riser;

a laterally extending second riser stop having a second riser abutting surface, the second riser stop extending away from the riser mount face and being longitudinally spaced a second distance from the stringer stop, the second distance equal to the first distance, the second riser mounting region located between the second riser stop and the first end, the second riser abutting surface adapted to abut a top of a riser such that the riser mounting face is positioned adjacent a side of the riser.

6. An apparatus as set forth in claim 5 further comprising:

A riser extension clip having an attaching face, an extension face and extension holes located on the extension face, at least a portion of the attaching face defining an attaching plane and at least a portion of the extension face defining an extension plane, the riser extension clip configured such that the attaching plane is generally perpendicular to the extension plane, the riser extension clip attached to the bracket such that the attaching face is in a face to face orientation with the stringer mount face and the extension face is adjacent one of the first and second mounting regions of the riser mounting face.

7. An apparatus as set forth in claim 5 wherein the riser mounting structure is a plurality of first riser holes and second riser holes in the riser mounting face, the first riser holes spaced longitudinally and between the first riser stop and the second end, the second riser holes spaced longitudinally and between the second riser stop and the first end, the first and second riser holes dimensioned to receive a wood screw.

8. An apparatus as set forth in claim 5 wherein the stringer mounting structure is a plurality of first stringer holes and second stringer holes in the stringer mounting face, the first stringer holes spaced longitudinally and between the stringer stop and the first end, the second stringer holes space longitudinally and between the stringer stop and the second end, the first and second stringer holes dimensioned to receive a wood screw.

9. An apparatus comprising:

a bracket having a first end opposite a second end, the bracket further having a stringer mount face and a riser mount face, the riser mount face including first and second riser mounting regions, the stringer mount face and the riser mount face extending longitudinally between the first end and the second end, at least a portion of the stringer mount face defining a stringer mount plane, at least a portion of the riser mount face defining a riser mount plane, the bracket configured such that the stringer mount plane is generally perpendicular to the riser mount plane;

a riser mounting structure located on the riser mount face;

a stringer mounting structure located on the stringer mounting face;

a longitudinally extending stringer stop extending in a first direction away from and perpendicular to the stringer mount plane, the stringer stop having first and second abutting surfaces, one of the first and second abutting surfaces being adapted to abut a bottom of a stringer such that the stringer mounting face can be positioned adjacent a side of the stringer;

a laterally extending first riser stop having a first riser abutting surface, the first riser stop extending laterally away from the riser mount face in a second direction and being longitudinally spaced a first distance from the stringer stop, said second direction being substantially perpendicular to the first direction, the first riser mounting region located between the first riser stop and the second end, the first riser abutting surface adapted to abut a top of a riser such that the first riser mounting region of the riser mounting face is positioned adjacent a side of the riser;

a riser extension clip having an attaching face, an extension face, the extension face including an extension mounting structure, at least a portion of the attaching face defining an attaching plane and at least a portion of the extension face defining an extension plane, the riser extension clip configured such that the attaching plane is generally perpendicular to the extension plane, the riser extension clip attached to the bracket such that the attaching face is in a face to face orientation with the stringer mount face and the extension face is adjacent the first riser mounting region.

10. A method of creating a form for pouring concrete steps comprising:

providing an apparatus comprising a bracket having a first end opposite a second end, the bracket further having a stringer mount face and a riser mount face, the riser mount face including first and second riser mounting regions, the stringer mount face and the riser mount face extending longitudinally between the first end and the second end, at least a portion of the stringer mount face defining a stringer mount plane, at least a portion of the riser mount face defining a riser mount plane, the bracket configured such that the stringer mount plane is generally perpendicular to the riser mount plane, the apparatus further comprising a riser mounting structure located on the riser mount face, a stringer mounting structure located on the stringer mounting face, a longitudinally extending stringer stop extending away from and perpendicular to the stringer mount plane, the stringer stop having first and second abutting surfaces, a laterally extending first riser stop having a first riser abutting surface, the first riser stop extending away from the riser mount face and being longitudinally spaced a first distance from the stringer stop, a laterally extending second riser stop having a second riser abutting surface, the second riser stop extending away from the riser mount face and being longitudinally spaced a second distance from the stringer stop, the first distance equal to the second distance, the first riser mounting region located between the first riser stop and the second end, the second riser mounting region located between the second riser stop and the first end;

providing a stringer, the stringer having a stringer bottom, a first stringer side and a second stringer side;

providing a riser, the riser having a riser top and a riser side; securing the apparatus to the stringer; and securing the apparatus to the riser.

11. A method as set forth in claim 10 wherein the securing the apparatus to the stringer step further comprises placing the stringer mounting face adjacent the first stringer side such that the first abutting surface of the stringer stop abuts the stringer bottom; and wherein the securing the apparatus to the riser step further comprises placing the first mounting region adjacent the riser side such that the riser top abuts the first riser abutting surface.

12. A method as set forth in claim 10 wherein the securing the apparatus to the stringer step further comprises placing the stringer mounting face adjacent the first stringer side such that the second abutting surface of the stringer stop abuts the stringer bottom; and wherein the securing the apparatus to the riser step further comprises placing the second mounting region adjacent the riser side such that the riser top abuts the second riser abutting surface.

13. A method as set forth in claim 10 further comprising:

providing a riser extension clip having an attaching face and an extension face, the extension face including an extension mounting structure, at least a portion of the attaching face defining an attaching plane and at least a portion of the extension face defining an extension plane, the riser extension clip configured such that the attaching plane is generally perpendicular to the extension plane, the riser extension clip attached to the bracket such that the attaching face is in a face to face orientation with the stringer mount face and the extension face is adjacent one of the first and second riser mounting regions.

14. A method as set forth in claim 10 wherein the providing a stringer step further comprises creating an outline of the steps on the stringer.

15. A method as set forth in claim 14 further comprising:

creating a concrete form by repeating at least some of the previous steps.

16. A method as set forth in claim 15 further comprising:

pouring concrete into the concrete form.

17. A method as set forth in claim 16 further comprising:

removing the apparatus from the form.

18. A method as set forth in claim 17 further comprising:

reusing the apparatus.

* * * * *